US011558695B2

(12) United States Patent
Halverson

(10) Patent No.: US 11,558,695 B2
(45) Date of Patent: Jan. 17, 2023

(54) CONDENSER MICROPHONE PATTERN ADJUSTMENT

(71) Applicant: Shure Acquisition Holdings, Inc., Niles, IL (US)

(72) Inventor: Jon Caleb Halverson, Des Plaines, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 16/836,316

(22) Filed: Mar. 31, 2020

(65) Prior Publication Data

US 2021/0306760 A1 Sep. 30, 2021

(51) Int. Cl.
*H04R 19/01* (2006.01)

(52) U.S. Cl.
CPC ..... *H04R 19/016* (2013.01)

(58) Field of Classification Search
CPC .... H04R 19/04; H04R 19/016; H04R 19/005; H04R 19/00; H04R 25/00; H04R 5/02; H04R 1/24; H04R 1/403; H04R 1/26; H04R 1/083; H04R 1/086; H04R 1/04; H04R 1/342; H04R 1/38; H04R 9/063; H04R 9/08; H04M 1/19
USPC ..... 381/174, 369, 170, 182
See application file for complete search history.

(56) References Cited

U.S. PATENT DOCUMENTS 2,678,967 A * 5/1954 Grosskopf ..... H04R 3/005 381/113
3,118,022 A 1/1964 Sessler et al.
4,329,547 A 5/1982 Imai
4,491,697 A 1/1985 Tanaka et al.
4,757,545 A 7/1988 Rosander
4,888,807 A 12/1989 Reichel
7,356,151 B2 4/2008 Seknicka
(Continued)

FOREIGN PATENT DOCUMENTS

CN 2829267 Y 10/2006
CN 101754078 A 6/2010
(Continued)

OTHER PUBLICATIONS

MXL Revelation Multi-pattern Valve Microphone, www.soundonsound.com, Sep. 2010.
(Continued)

*Primary Examiner* — Ahmad F. Matar
*Assistant Examiner* — Sabrina Diaz
(74) *Attorney, Agent, or Firm* — Banner & Witcoff, Ltd.

(57) ABSTRACT

A condenser microphone with at least two microphone capsules, each including a diaphragm and a backplate. The backplates of both the first capsule and second capsule having an electret bias. The first capsule having a first polar pattern, and the second capsule having a second polar pattern. The second capsule having an external voltage bias that is continuously variable over a certain voltage range. This external voltage bias can be applied to the second diaphragm or second backplate. The microphone's total polar pattern consists of a combination of the first polar pattern and the second polar pattern. Using the external voltage bias of the second capsule, the microphone's total polar pattern is continuously variable throughout a range set by the external voltage bias.

21 Claims, 10 Drawing Sheets

(56) References Cited

U.S. PATENT DOCUMENTS

| | | | | |
|---|---|---|---|---|
| 7,889,882 | B2 | 2/2011 | Marshall | |
| 8,483,412 | B2 * | 7/2013 | Statham | H04R 3/005 381/174 |
| 8,644,529 | B2 | 2/2014 | Ejaz et al. | |
| 8,744,101 | B1 | 6/2014 | Burns | |
| 8,848,950 | B2 | 9/2014 | Shimura | |
| 8,879,752 | B2 | 11/2014 | Harano et al. | |
| 9,456,283 | B2 | 9/2016 | Chiang et al. | |
| 9,693,135 | B2 | 6/2017 | Haas-Christensen et al. | |
| 9,998,811 | B1 | 6/2018 | Avant | |
| 10,009,684 | B2 | 6/2018 | Shumard et al. | |
| 2005/0220314 | A1 * | 10/2005 | Lang | H04R 3/00 381/113 |
| 2007/0237345 | A1 | 10/2007 | Zhang et al. | |
| 2010/0296674 | A1 * | 11/2010 | Statham | H04R 3/005 381/174 |
| 2012/0093340 | A1 * | 4/2012 | Shimura | H04R 3/00 381/92 |
| 2015/0341720 | A1 | 11/2015 | Akino | |

FOREIGN PATENT DOCUMENTS

| | | | | |
|---|---|---|---|---|
| CN | 201699977 | U | 1/2011 | |
| DE | 2738978 | A1 | 3/1979 | |
| GB | 2324222 | A | 10/1998 | |
| JP | 2006295357 | A * | 10/2006 | H04R 19/01 |
| TW | M368988 | U | 11/2009 | |

OTHER PUBLICATIONS

CAD 1700VP Variable Polar Pattern Stick Condenser Mic, downloaded Oct. 22, 2019.

Mann Professional Condenser Microphones, Mann Condenser Microphone Tech Basics, downloaded Oct. 22, 2019.

Mary C. Gruszka, TVTechnology, Microphones With Switchable Polar Patterns, Updated: Feb. 23, 2018, Original: Oct. 17, 2006.

John Kean, Design and Performance of Electret Condenser Microphones, A century of development of condenser microphones, Aug. 12, 2016.

Shure KSM9 Microphone User Guide © 2015.

Shure KSM9/HS Microphone User Guide © 2017.

Josephson Engineering C715 Multipattern Condenser Microphone User Guide © 2016.

Nuemann M49 Microphone Operating Instructions Apr. 1960.

Jun. 4, 2021—(WO) International Search Report and Written Opinion—App PCT/US21/20273.

* cited by examiner

CONDENSER MICROPHONE PATTERN ADJUSTMENT

FIELD

The disclosure relates to a condenser microphone of which the polar pattern can be adjusted using the superposition of both electret and external biasing.

BACKGROUND

Microphones convert sound into an electrical signal through the use of a transducer that includes a diaphragm to convert sound into mechanical motion, which in turn is converted to an electrical signal. Microphones come in several types, including condenser, dynamic, ribbon, carbon, and laser. Condenser microphones, also known as capacitor microphones or electrostatic microphones, are among the more common. A condenser microphone, at the most basic level, is a capacitor with a thin plate that functions as a diaphragm and thicker backplate. A voltage or electric potential difference is created between the diaphragm and backplate. Often, this is done by the backplate receiving a fixed charge or voltage. Air pressure from sound waves striking the diaphragm causes the diaphragm to vibrate, which changes the distance between the two plates, causing a change in the capacitance of the microphone. The dynamic change in capacitance is reflected in a dynamic change of voltage across the capacitor, which is taken as the signal that is transmitted to an amplifying stage.

In most condenser microphones, the voltage bias of the backplate is created through two methods. The first method is through an external voltage source, which allows the adjustment of the voltage bias by adjusting the voltage provided by the external voltage source. The second method to create a voltage bias is using an electret material for the backplate. Electret materials are able to hold static electrical charge for long periods of time without an external supply. Biasing a microphone with an electret material has the benefit of not requiring an external power source, so it lends itself to handheld or wireless uses. However, electret biasing cannot be adjusted like external biasing can.

A major characteristic of microphones that influences microphone design is the microphone's polar pattern. This pattern defines a microphone's directionality, the sensitivity of a microphone to sounds arriving from different angles to the microphone's central axis. For example, an omnidirectional microphone is equally sensitive to sounds received from all directions. These microphones are often used in studio and other venues with good acoustics. A microphone with a cardioid polar pattern, so-called because the pattern resembles a heart, is sensitive to sounds received from the front of the microphone but is less sensitive or blocks sound received from the sides or back of the microphone. These microphones are often used when recording a singer during a live performance.

Other polar patterns include super-cardioid and hyper-cardioid, which are variations of a cardioid pattern and that have a more focused sensitivity to the sound received from the front of the microphone. But microphones with these patterns do not block sound received from behind the microphone as well as a cardioid microphone. Finally, a bi-directional microphone is equally sensitive to sound received along one axis, but sound received along the perpendicular axis is blocked out. Common polar patterns are illustrated in FIG. 1.

The various polarization patterns can also be described as a combination of the omnidirectional and bi-directional polar patterns. Mathematically, this is illustrated by the equation $1=A+B\cos\theta$, which has been normalized to 1. A is the omnidirectional portion of the pattern and B is the bi-directional portion. If one were to add equal proportions of the omnidirectional portion and bi-directional portion—i.e., $0.5+0.5\cos\theta$—the microphone would have a cardioid polar pattern. Table 1 shows how one could produce the common polar patterns using a dual diaphragm microphone that has both an omnidirectional portion and a bi-directional portion.

TABLE 1

| Pattern | Equation ($A + B\cos\theta$) |
|---|---|
| Omnidirectional | 1 |
| Sub-cardioid | $0.7 + 0.3\cos\theta$ |
| Cardioid | $0.5 + 0.5\cos\theta$ |
| Super-cardioid | $0.37 + 0.63\cos\theta$ |
| Hyper-cardioid | $0.25 + 0.75\cos\theta$ |
| Bi-directional | $\cos\theta$ |

As mentioned, certain polar patterns are better suited for certain environments or uses (e.g., studio recording versus live recording). But having a different microphone for every situation can become cumbersome, so manufactures design microphones that have the ability to change between different polar patterns. One way to build a microphone with this ability is to include multiple microphone capsules, each containing a diaphragm and backplate tuned to a specific polar pattern. The outputs of these different capsules are then added to or subtracted from each other to form new polar patterns.

For example, a condenser microphone may include two capsules, each including a diaphragm and a backplate. One capsule may have an omnidirectional polar pattern while the other capsule may have a bi-directional polar pattern. By adjusting the amount of each signal that is included in the final microphone output, the microphone may exhibit multiple different polar patterns. One way to do this would be to utilize external biasing on one or both capsules. The sensitivity of each capsule is proportional to its bias voltage. By adjusting the external biasing, one would be able to adjust the sensitivity or strength of the capsules, and thus, each capsule's contribution to the microphone's total output.

However, in real world applications, microphones are often limited to only a few options. As an example, a dual diaphragm condenser microphone may include two diaphragms with a common backplate in which both sides have a cardioid polar pattern. If the two back-to-back cardioids are added together, the microphone would have an omnidirectional polar pattern: $(0.5+0.5\cos\theta)+(0.5-0.5\cos\theta)=1$. The difference in sign on the B value is attributable to the front facing cardioid pattern, if assigned a positive polarity, having the opposed polarity of the back facing cardioid pattern, which faces the opposed direction. When the cardioids are subtracted from each other, the microphone would have a bi-directional polar pattern: $(0.5+0.5\cos\theta)-(0.5-0.5\cos\theta)=\cos\theta$. Further, subtracting only half as much of the rear cardioid creates a microphone with a hyper-cardioid pattern: $(0.5+0.5\cos\theta)-0.5(0.5-0.5\cos\theta)=0.25+0.75\cos\theta$. These simple adjustments are often done with a switch on the microphone.

In another example, a dual diaphragm condenser microphone may include two microphone capsules, one in front of the other, where each capsule includes a diaphragm and a backplate. The front capsule is tuned to a point half-way between cardioid and super-cardioid. When the rear capsule, which has a cardioid pattern, has the same polarity as the front capsule, the microphone's pattern is cardioid. When the rear capsule is switched to have the opposite polarity as the front capsule, the microphone's pattern is super-cardioid. This technique can be implemented such that each pattern of the microphone's total output to have similar sensitivities. This technique can be done with other patterns. For example, the front capsule is tuned between hyper-cardioid and sub-cardioid, and the back capsule is used to switch between the two patterns based on its sensitivity and polarity in relationship with the front capsule.

However, as can be seen, microphones that allow switching between different polar patterns only allow the selection of a discrete number of patterns, especially if their backplate is using electret biasing. Further, although external biasing may allow a wider variety of patterns for a microphone, this biasing method usually limits the mobility of the microphone and is generally unworkable for smaller, wireless microphones.

SUMMARY

The following presents a simplified summary of the disclosure in order to provide a basic understanding of some aspects of the disclosure. This summary is not an extensive overview of the disclosure. It is not intended to identify key or critical elements of the invention or to delineate the scope of the invention. The following summary merely presents some concepts of the disclosure in a simplified form as a prelude to the more detailed description provided below.

Aspects of this disclosure relate to a condenser microphone with two microphone capsules, each including a diaphragm and a backplate. The diaphragms separately receive sound and convert it to electrical signals. Each microphone capsule has its own polar pattern, which represents the sensitivity of the microphone capsule to sound received from different angles. Through the use of superposition, the outputs of the two microphone capsules are combined to a single microphone output that has a single polar pattern.

With another aspect of this disclosure, each diaphragm and corresponding backplate microphone may be biased by two different methods. The first method is by biasing a backplate with an electret material or similar biasing type material. This method includes using an electret material as a backplate, and thus biasing is not variable after the microphone has been built. The second method is by providing an external bias voltage. This may be done by applying a voltage to a diaphragm. This method of biasing is adjustable, so one can adjust the level of biasing after the microphone has been built, and in this way, adjust the polar pattern of the microphone.

With another aspect of this disclosure, both electret and external biasing may be used simultaneously on a microphone. This allows for the microphone's polar pattern to be adjusted with a high degree of continuous variability. Similarly, this can also be used to adjust the microphone's sensitivity.

With another aspect of this disclosure, the adjustment of the microphone's polar pattern may be done by dials or switches on the microphone itself. Alternatively, these adjustments may be done remotely through wireless technology.

With another aspect of this disclosure, the external bias voltage may be applied to any combination of microphone capsules in any number of mechanical configurations. For example, in a dual diaphragm microphone, there are multiple configurations, including: (1) a front diaphragm and a front backplate followed by a back diaphragm and a rear backplate, in that order; (2) two diaphragms on the outside with two backplates in the middle; and (3) two diaphragms on the outside and a shared backplate in the middle. Alternatively, the first capsule and the second capsule may be aligned in the housing so that the capsules are on perpendicular axes.

With another aspect of this disclosure, the combination of electret and external biasing allow for a microphone with continuous variability that is also low power. This is useful in high-tier wireless handled microphones.

BRIEF DESCRIPTION OF THE DRAWINGS

A more complete understanding of the present disclosure and the advantages thereof may be acquired by referring to the following description in consideration of the accompanying drawings, in which like reference numbers indicate like features, and wherein.

DETAILED DESCRIPTION

In the following description, reference is made to the accompanying drawings, which form a part hereof, and in which is shown by way of illustration various examples in which aspects may be practiced. References to "embodiment," "example," and the like indicate that the embodiment(s) or example(s) of the invention so described may include particular features, structures, or characteristics, but not every embodiment or example necessarily includes the particular features, structures, or characteristics. It is contemplated that certain embodiments or examples may have some, all, or none of the features described for other examples. And it is to be understood that other embodiments and examples may be utilized and structural and functional modifications may be made without departing from the scope of the present disclosure, including adjusting the electrical component values.

Unless otherwise specified, the use of the serial adjectives, such as, "first," "second," "third," and the like that are used to describe elements, are used only to indicate different elements that can be similar. But the use of such serial adjectives are not intended to imply that the elements must be provided in given order, either temporally, spatially, in ranking, or in any other way.

Also, the terms "front," "rear," "back," "side," "parallel," "perpendicular," and the like, as well as descriptions in relation to axes, may be used in this specification to describe various example features and elements. But these terms are used herein as a matter of convenience, for example, based on the example orientations shown in the figures and/or the orientations in typical use. Nothing in this specification should be construed as requiring a specific three dimensional or spatial orientation of structures in order to fall within the scope of the claims.

Figure 1:
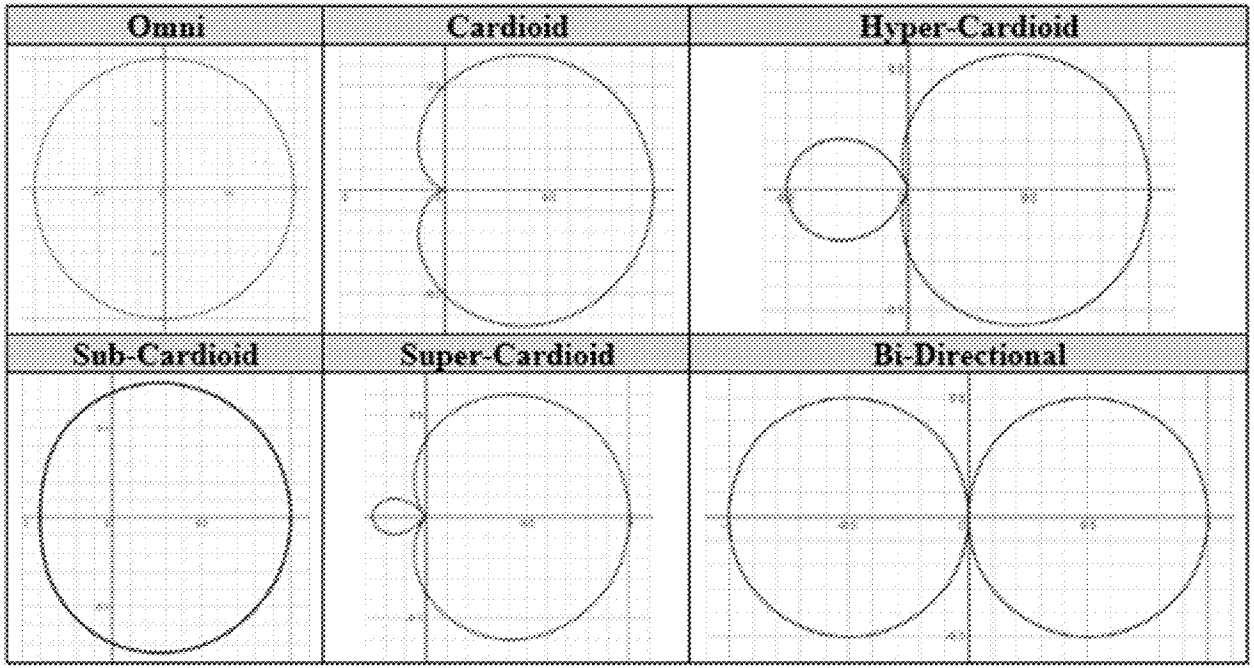
Fig. 1 Prior Art
FIG. 1 shows diagrams of common microphone polar patterns.
Figure 2:
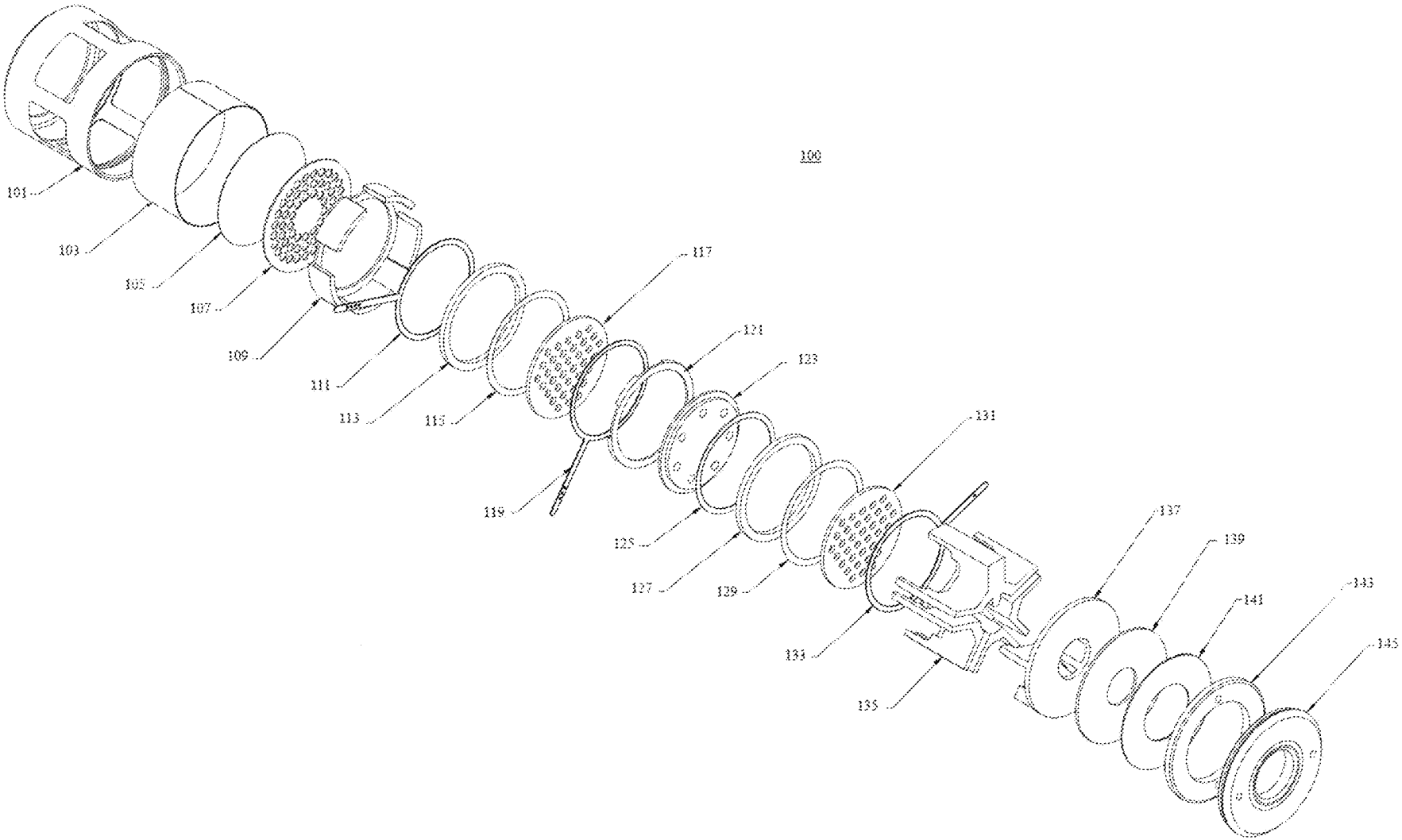
FIG. 2 shows an exploded view of an example condenser microphone.

FIG. 2 shows an exploded view of example microphone 100. Capsule housing 101 contains the various components of the microphone and includes openings that allow sound to reach those components. Side screen 103 protects the components of microphone 100 from debris and moisture from the side. Similarly, screen 105 protects the components of the microphone from debris and moisture from the front. Under screen 105 is grill 107. Grill 107 can be made of metal, such as brass, steel, or iron. Grill 107 has a number of different functions, including providing protection from physical damage and additional protection from debris and moisture. Grill 107 also acts as a windscreen, which helps dissipate gusts of air that would overload the microphone's diaphragm. This helps reduce popping or plosiveness in the microphone signal.

Front diaphragm 113 rests within insulating frame 109. Insulating frame 109 separates the various internal conductive components for microphone 100 from the outer components, such as capsule housing 101 and grill 107. Resting in between front diaphragm 113 and insulating frame 109 is front diaphragm electrical contact 111. Separating front diaphragm 113 and front backplate 117 is insulating spacer 115. Front backplate electrical contact 119 rests in insulating spacer 121. Insulating spacer 121 interacts with insulating frame 109 to contain the various components of the front capsule.

Front diaphragm electrical contact 111 and front backplate electrical contact 119 allow the monitoring of the electrical signals of front diaphragm 113 and front backplate 117, respectively. These electrical signals will change as sound interacts with front diaphragm 113, changing the capacitance between front diaphragm 113 and front backplate 117. In this example, electrical signal representing received audio signal is taken from front backplate 117. Front diaphragm electrical contact 111 and front backplate electrical contact 119 also allow any external bias to be applied to either front diaphragm 113 and front backplate 117, respectively.

Acoustic resistance element 123 acoustically isolates the front capsule from the rear capsule, which includes rear diaphragm 127 and rear backplate 131. This is placed between insulating spacer 121 and rear diaphragm electrical contact 125. Rear diaphragm 127 is separated from rear backplate 131 by insulating spacer 129. Rear diaphragm electrical contact 125 and rear backplate electrical contact 133 allow the monitoring of the electrical signals of rear diaphragm 127 and rear backplate 131, respectively. These electrical signals will change as sound interacts with rear diaphragm 127, changing the capacitance between rear diaphragm 127 and rear backplate 131. In this example, electrical signal representing received audio signal is taken from rear front backplate 131. Rear diaphragm electrical contact 125 and rear backplate electrical contact 133 also allow any external bias to be applied to either rear diaphragm 127 and rear backplate 131, respectively.

Plastic frame 135 interacts with acoustic resistance element 123 to contain the components of the rear capsule. Plastic frame 135 has various grooves that interact with plastic contact guide 137 to organize and allow the various electrical connections to pass through to the circuitry of the microphone. Plastic contact guide 137 rests on rubber cushion 139, which rests on plastic washer 141. Internal retaining ring 143 and external regaining ring 145 function together to secure the various components of microphone 100 during use.

In microphone 100, the front capsule, which includes front diaphragm 113 and front backplate 117, is tuned between two common polar patterns; in this example, those patterns are hyper-cardioid and sub-cardioid. Also in this example, front backplate 117 has an electret bias of −100 V. Because this backplate is biased with an electret material or a similar biasing type material, it cannot be adjusted.

In microphone 100, the rear capsule, which includes rear diaphragm 127 and rear backplate 131, is tuned to a standard cardioid pattern. In this example, the rear capsule has a variable bias. This variability allows microphone 100 to have a continuously variable polar pattern anywhere between the two polar patterns of the front capsule, which in this example is hyper-cardioid and sub-cardioid patterns. To achieve this continuous variability, one could vary the voltage bias of the rear backplate 131 between −55 V and +55 V, but varying above and below 0 V can create issues with the switching polarity. Rather, an easier method would be to apply the same range of voltage but only at positive or negative voltages, such as 0 V to +110 V or 0 V to −110 V. Using superposition, the goal of biasing the rear capsule between −55 V and +55 V can be achieved by applying an electret bias of −55 V to rear backplate 131 and applying a variable external voltage of 0 V to −110 V to rear diaphragm 131. Alternatively, a variable external voltage of 0 V to +110 V could be applied to rear backplate 131.

Figure 3:
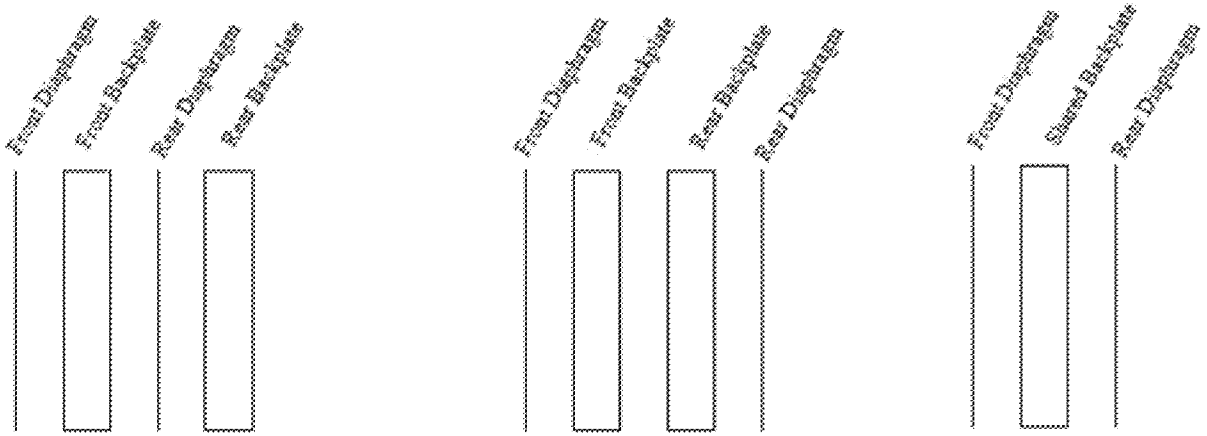
FIG. 3 shows a diagram of three different orientations of diaphragms and backplates in a dual diaphragm condenser microphone.

Microphone 100 is configured so that the diaphragm and backplates are oriented the same direction. However, this is not necessary. For instance, the rear capsule could be flipped so that the two backplates are together. Alternatively, the two diaphragms could share a single backplate. Diagrammed, these three variations are found in FIG. 3.

The chosen mechanical arrangement influences how each capsule's polar pattern is combined with the other capsule's polar pattern to produce the final microphone output. The mechanical arrangement also affects how biasing is applied to each capsule. External bias voltages may be applied to any combination of diaphragms or backplates. Electret biasing can be applied to either side of a back plate, or both sides in the case of a shared backplate. Electrical signals can also be taken from any combination of diaphragms or backplates. However, one must be mindful of how the orientation of the two capsules affects the polarity when adding together the outputs from each capsule. For example, flipping the rear capsule so that the two backplates are near each other (i.e., the middle arrangement above) also flips the polarity when adding the rear capsule's output to the front capsule.

Figure 4:
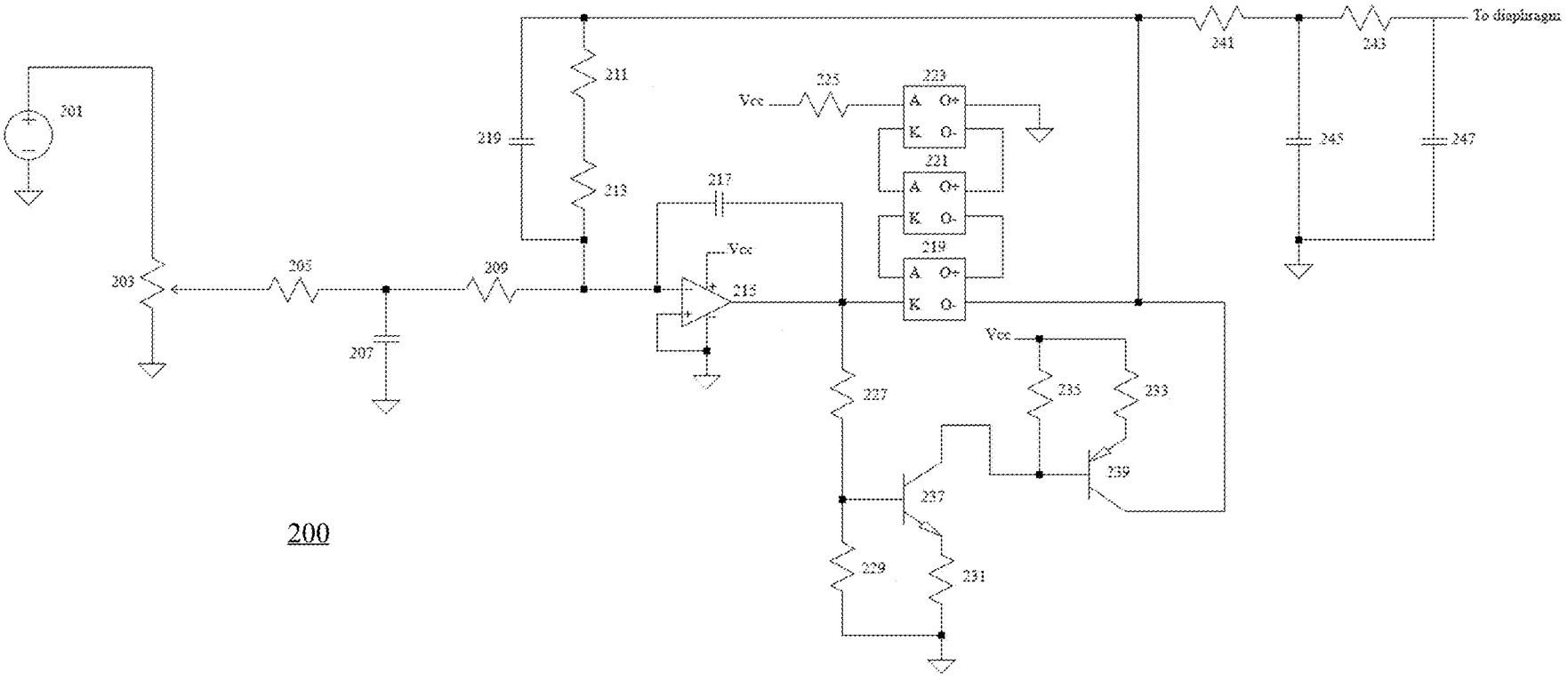
FIG. 4 shows a schematic of an example external biasing circuit for a condenser microphone.

FIG. 4 shows an example of a schematic for circuit 200 that applies the external bias voltage to rear diaphragm 127 in microphone 100 of FIG. 2. Circuit 200 is connected to external biasing reference voltage 201 which is connected to a DC voltage gain regulator 203. Using DC voltage gain regulator 203, various voltages can be applied to bias the rear diaphragm 127, which is connected to circuit 200 at resistor 243, as indicated. In this example, DC voltage gain regulator 203 allows a voltage range of 0 V to 5 V. Control of DC voltage gain regulator 203 can be physical (e.g., with a dial or knob on the microphone) or through a wireless remote.

Circuit 200 is designed as a closed loop circuit to allow feedback to control for temperature, lot-to-lot differences, aging, and other variations. In this example, circuit 200 is in an inverting gain configuration. This means that the input voltage is applied to the inverting input terminal of op-amp 215, making the output signal from op-amp 215 the opposite polarity or 180 degrees out of phase with the input signal.

On the input side, a low pass filter, consisting of resistor 205 and capacitor 207, is included to provide a stable input signal to the inverting input terminal of op-amp 215, especially since the input voltage will change throughout operation as a user adjusts the external voltage bias in order to adjust the polar pattern of the microphone. Input resistor 209 separates the input signal from the feedback signal and creates a virtual earth summing point. Resistors 211 and 213 are feedback resistors with values chosen in relation to input resister 209 and in view of the goal gain of circuit 200. In this example, two resistors were used rather than one large resistor due to real world constraints of resistors, which are limited by the maximum voltage that can safely be applied to a single resistor. Capacitors 217 and 219 function as low pass filters to increase performance by providing more stability in the system.

In this example, the non-inverting terminal of op-amp 215 is connected to ground, making ground the common mode voltage of op-amp 215 inputs. Connecting the non-inverting terminal to ground was done in this example to simplify the circuit design because ground provides an easy reference point. However, not all op-amps necessarily have the capability to have their common mode voltage be at ground. In that case, one would have a non-ground reference that could vary the common mode voltage during operation, creating additional complexity in the circuit design to account for the this.

The output of op-amp 215 is connected photocouplers 219, 221, and 223. Photocouplers transfer electrical signals using light. The components of a photocoupler include a light emitting diode at the input and a chain of photodiodes at the output. In one construction, a photocoupler, such as Toshiba's TLP3924, includes an infrared emitting diode that is optically coupled to a series connected photodiode array. In FIG. 4, the "A" indicates the anode and "K" indicates the cathode of the diode on the input side. On the diode of the output side, O+ indicates the anode and O-indicates the cathode.

In FIG. 4, photocouplers 219, 221, and 223 are connected in a string to create the large bias voltage appropriate for biasing condenser microphones. The choice of photocoupler depends on the biasing goal. In this example, the photocouplers 219, 221, and 223 can each maintain an output voltage of above 30 V with a much smaller input, such as ~1.2 V and −2 mA at each photocoupler. Resistor 225 is an input resistor that limits the maximum current to protect the photocouplers. Using these photocouplers or similar devices that can maintain a large output voltage with a small input provides the capability of having a low power condenser microphone with a highly adjustable polar pattern. One potential use for this low power method of biasing condenser microphones would be in wireless and wired handheld microphones.

As illustrated in FIG. 4, the outputs of photocoupler 219, 221, and 223 are connected to rear diaphragm 127 of microphone 100 through resistors 241 and 243. The values of these resistors are large in order minimize the amount of current that flows to rear diaphragm 127, creating a DC high-impedance node. Capacitors 245 and 247 are included to ground any AC signals before they reach rear diaphragm 127. Resistors 241 and 243 along with capacitors 245 and 247 effectively provide a two-stage high-impedance low pass filter.

Circuit 200 also includes a pulldown circuit attached to the inputs and outputs of photocouplers 219, 221, and 223. This pulldown circuit allows photocouplers 219, 221, and 223 to charge and discharge at similar rates. When applying voltage, photocouplers can quickly build up the required bias voltage. However, when the voltage is removed, the photocouplers will eventually discharge the bias voltage, but it takes time, discharging through the feedback resistors if the pulldown circuit was not present. The pulldown circuit makes this discharge quicker by providing a path to ground. In this example, the pulldown circuit comprises transistors 237 and 239 and resistors 227, 229, 231, 233, and 235.

Circuit 200 in FIG. 4 was designed to provide a continuously adjustable external voltage bias to rear diaphragm 127 of microphone 100 with a range of −110 V to 0 V. The resistor and capacitor values of this example are found in Table 2.

TABLE 2

| Resistor | Value (Ω) | Resistor | Value (Ω) | Capacitor | Value (F) |
|---|---|---|---|---|---|
| 205 | 2M | 229 | 100 k | 207 | 2.2 n |
| 209 | 2.5M | 231 | 500 k | 217 | 2.2 n |
| 211 | 50M | 233 | 500 k | 219 | 2.2 n |
| 213 | 50M | 235 | 1M | 245 | 2.2 n |
| 225 | 200 | 241 | 50M | 247 | 4.7 n |
| 227 | 500 k | 243 | 50M | | |

Figure 5B:
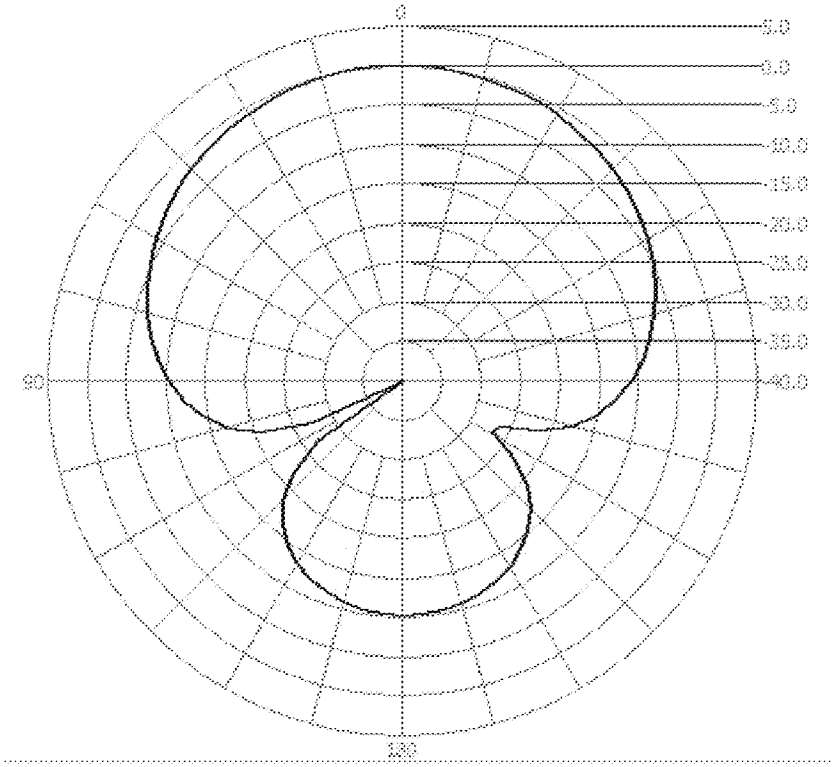
FIG. 5B illustrates a polar plot of the example condenser microphone of FIG. 2 with a −38 V external bias applied to the rear diaphragm.
Figure 5A:
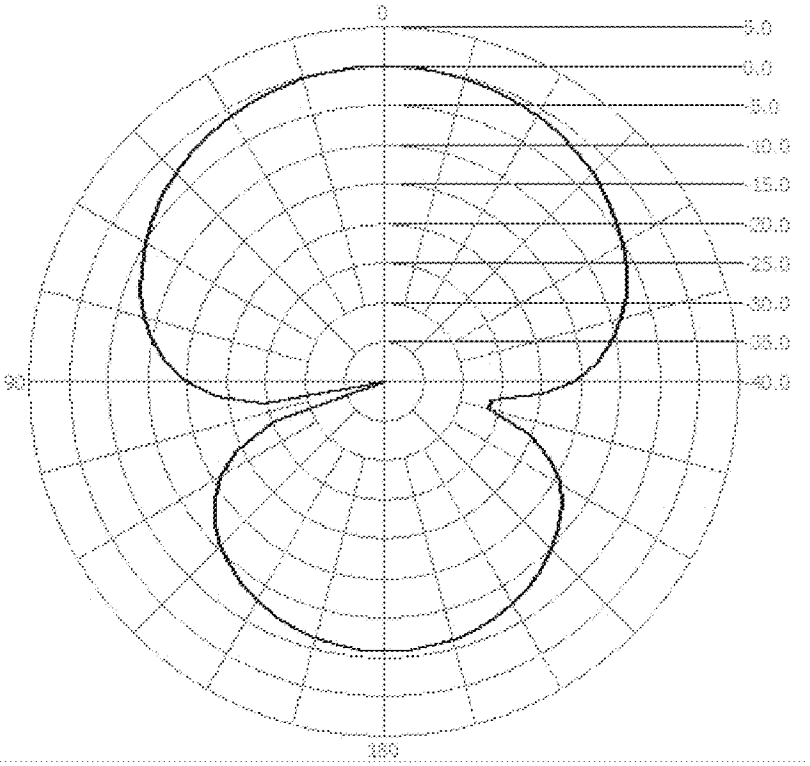
FIG. 5A illustrates a polar plot of the example condenser microphone of FIG. 2 with a 0 V external bias applied to the rear diaphragm.

FIGS. 5A-5D illustrate polar plots of microphone 100 at various external bias levels, showing the variability of the pattern of the microphone throughout the external biasing voltage range. For example, FIG. 5A shows the polar plot with an external bias of 0 V, which makes rear backplate 131 have a bias of −55 V, or the amount of its electret biasing. This biasing gives the microphone a hyper-cardioid pattern. By changing the external bias to −38 V, rear backplate 131 has a bias of −17 V, or −55 V subtracting −38 V. This biasing gives the microphone a super-cardioid pattern, as shown in FIG. 5B. As illustrated, the super-cardioid pattern is less receptive to sound from behind the microphone and receptive to sound from a wider angle in front of the microphone.

Figure 5D:
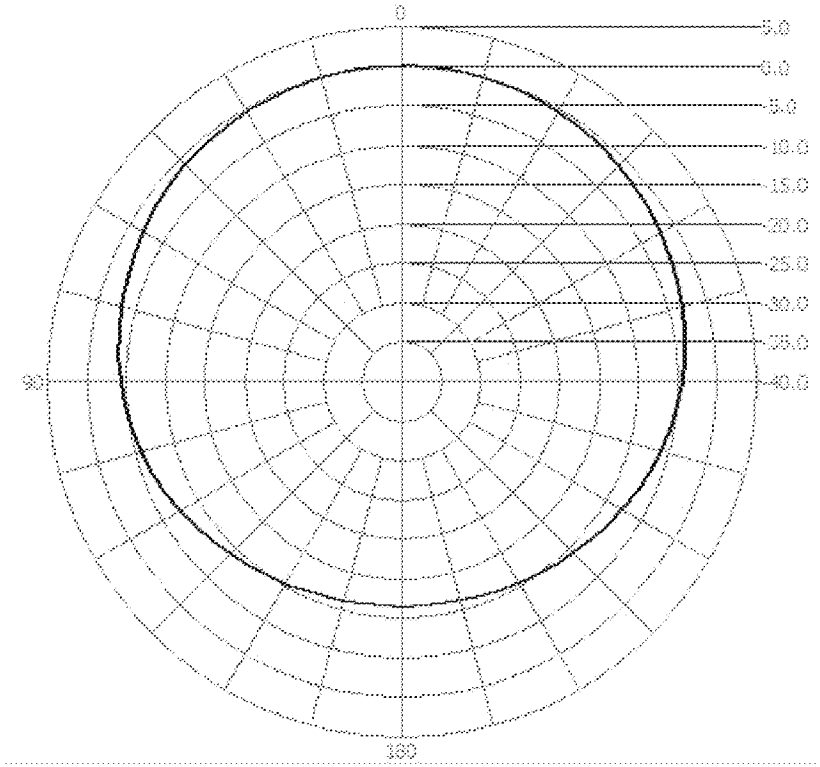
FIG. 5D illustrates a polar plot of the example condenser microphone of FIG. 2 with a −110 V external bias applied to the rear diaphragm.
Figure 5C:
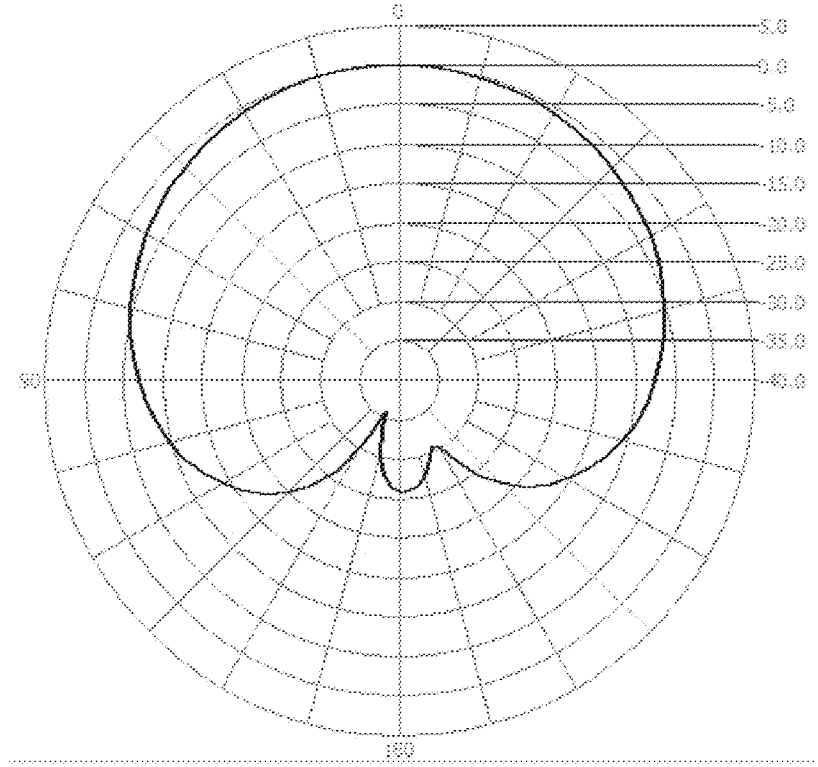
FIG. 5C illustrates a polar plot of the example condenser microphone of FIG. 2 with a −76 V external bias applied to the rear diaphragm.

FIG. 5C shows a polar plot with an external bias of −76 V, which makes rear backplate 131 have a bias of 17 V. This biasing gives the microphone a cardioid pattern, which has little sensitivity to sound from behind the microphone. By changing the external bias to −110 V, the rear backplate 131 has a bias of 55 V. This biasing gives the microphone a sub-cardioid pattern, as shown in FIG. 5D. Because the external voltage is continuously variable to any point in between 0 V to −110 V, these figures show just four options.

Figure 6A:
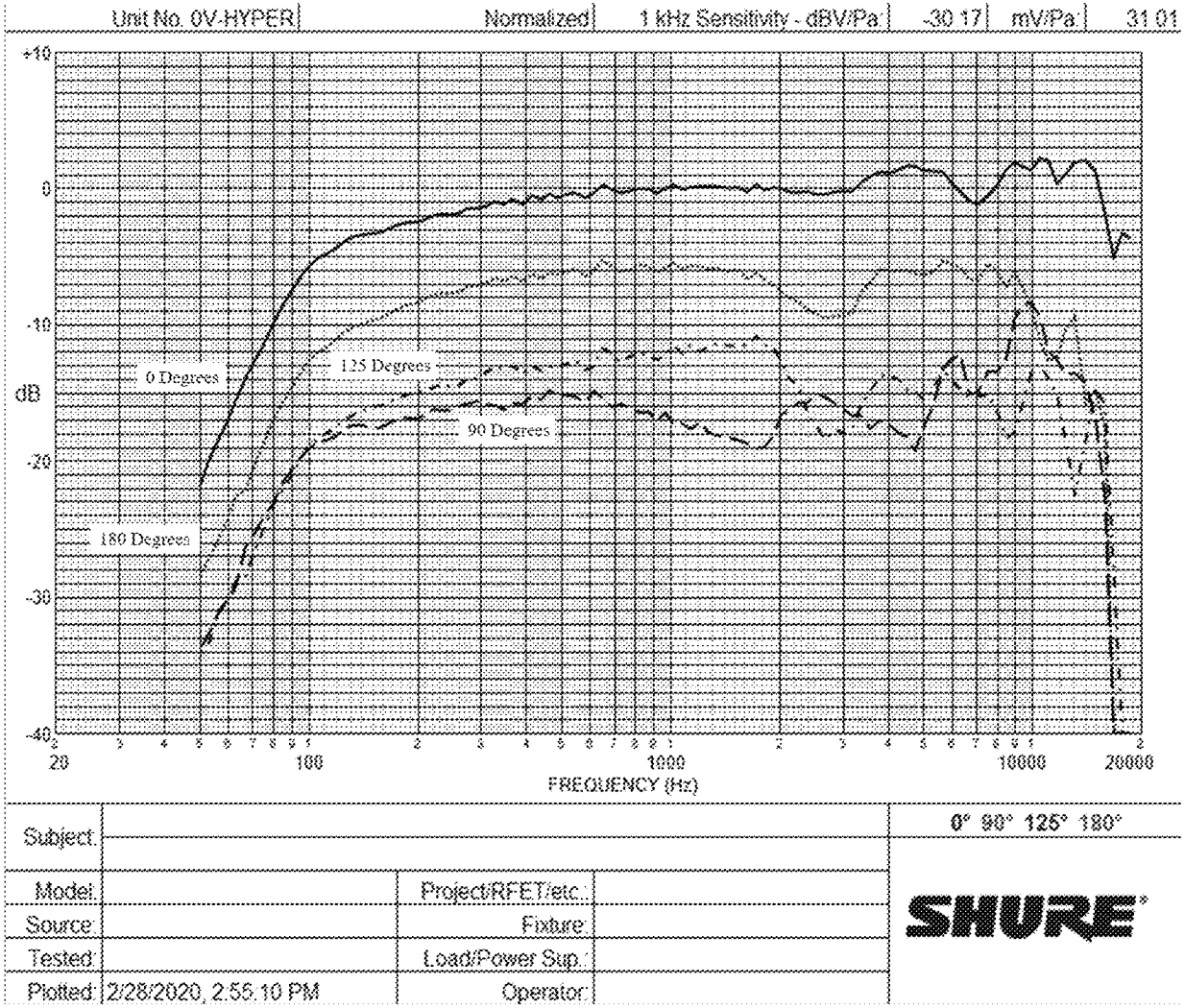
FIG. 6A illustrates a frequency response plot of the example condenser microphone of FIG. 2 with a 0 V external bias applied to the rear diaphragm.

FIGS. 6A-6D illustrate frequency plots of microphone 100 at various external bias levels, showing how receptive the microphone is throughout the voltage range and at various angles. For example, FIG. 6A shows the frequency plot with an external bias of 0 V, giving the microphone a hyper-cardioid pattern as illustrated in FIG. 5A. Microphone 100 is most receptive to frequencies at 0° (solid line), which is in front of the microphone. FIG. 6A shows that microphone 100 is second most receptive to frequencies at 180° (dotted line), or directly behind the microphone. This is consistent with FIG. 5A, which shows a hyper-cardioid pattern that is most receptive to frequencies in front of and behind the microphone. In contrast, at 90° (dashed line) and 125° (dot and dash line), FIG. 6A shows that microphone 100 is less receptive at this bias voltage, which is again consistent with a hyper-cardioid pattern as illustrated in FIG. 5A.

Figure 6B:
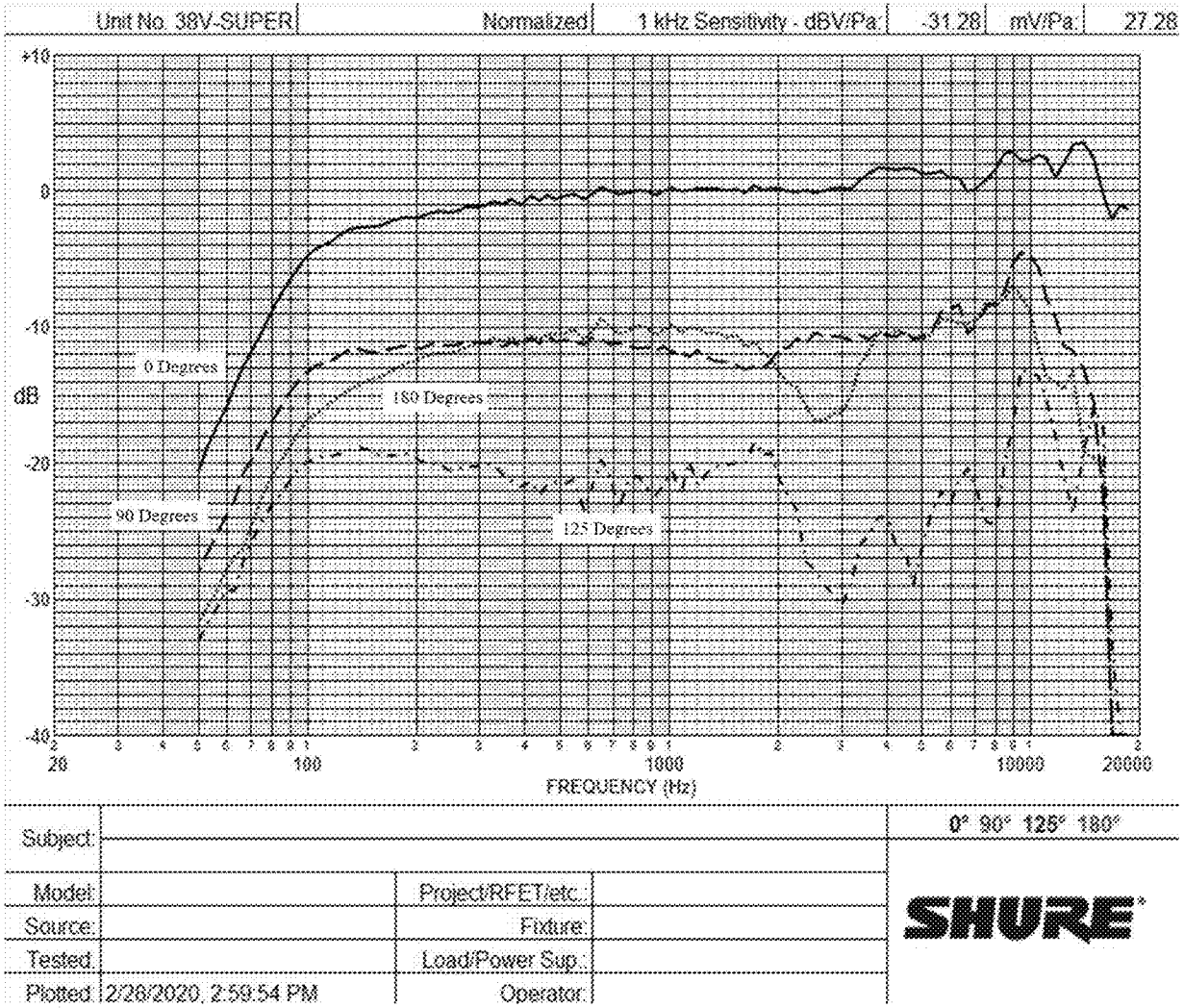
FIG. 6B illustrates a frequency response plot of the example condenser microphone of FIG. 2 with a −38 V external bias applied to the rear diaphragm.

FIG. 6B illustrates the frequency plot of microphone 100 with an external bias of −38 V, giving the microphone a super-cardioid pattern as illustrated in FIG. 5B. This pattern is similar to the hyper-cardioid pattern shown in FIGS. 5A and 6A. As can be seen, microphone 100 is again most receptive to frequencies at 0° (solid line), or in front of the microphone, but microphone 100 is far less receptive to sound being received from behind the microphone at 125° (dot and dash line) or 180° (dotted line). Further, microphone 100 is much more receptive now to frequencies at 90° (dashed line), consistent with a super cardioid pattern as illustrated in FIG. 5B.

Figure 6C:
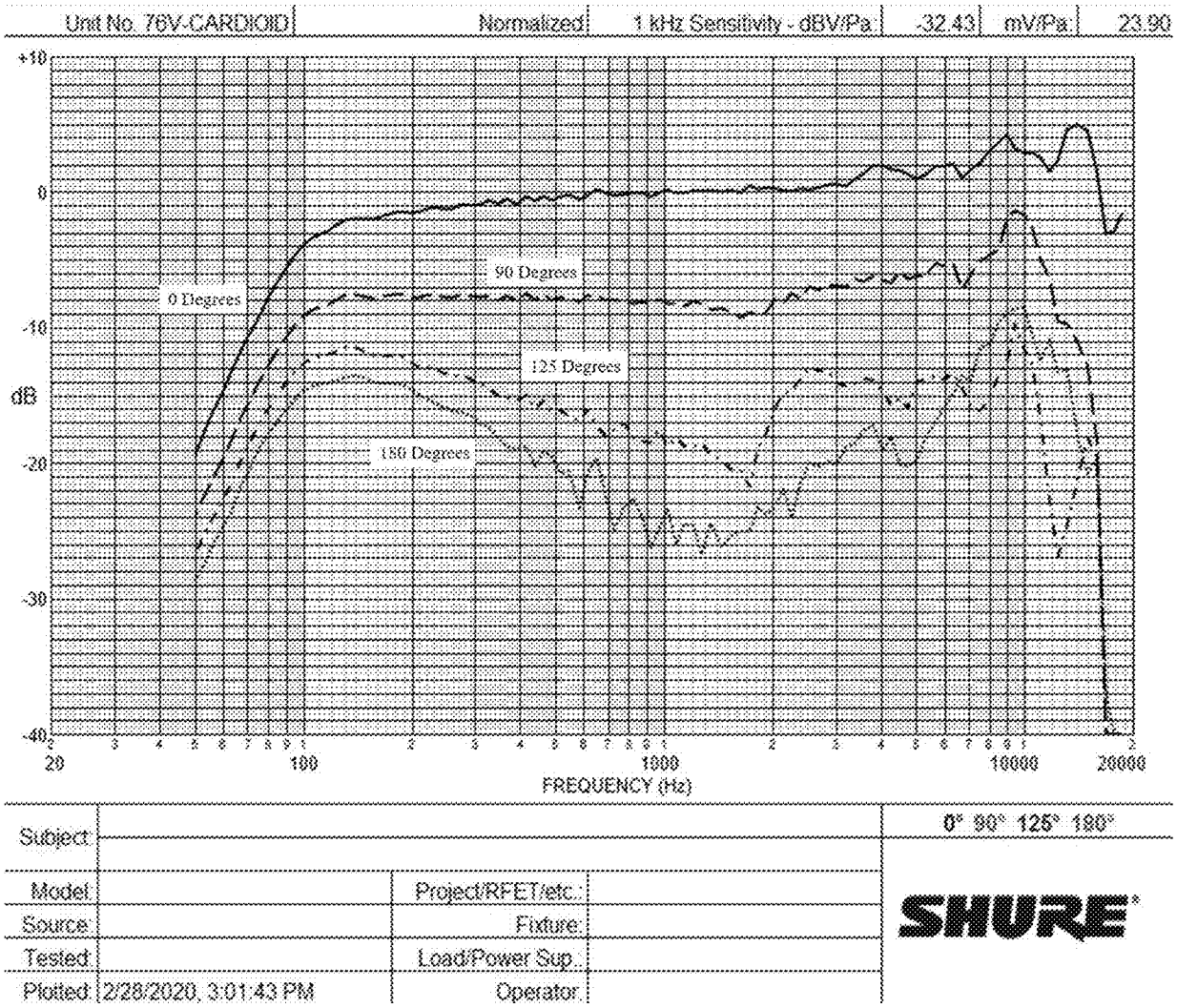
FIG. 6C illustrates a frequency response plot of the example condenser microphone of FIG. 2 with a −76 V external bias applied to the rear diaphragm.

FIG. 6C illustrates the frequency plot of microphone 100 with an external bias of −76 V, giving the microphone a cardioid pattern as illustrated in FIG. 5C. Of the previous patterns, this pattern is the least receptive of sound from behind the microphone. As shown, microphone 100 is again most receptive to frequencies at 0° (solid line), but it also is much more receptive of sound received at 90° (dashed line) than in FIG. 6B. Here, microphone 100 is also not very receptive to sound received at either 125° (dot and dash line) or at 180° (dotted line). This is consistent with the cardioid pattern illustrated in FIG. 5C.

Figure 6D:
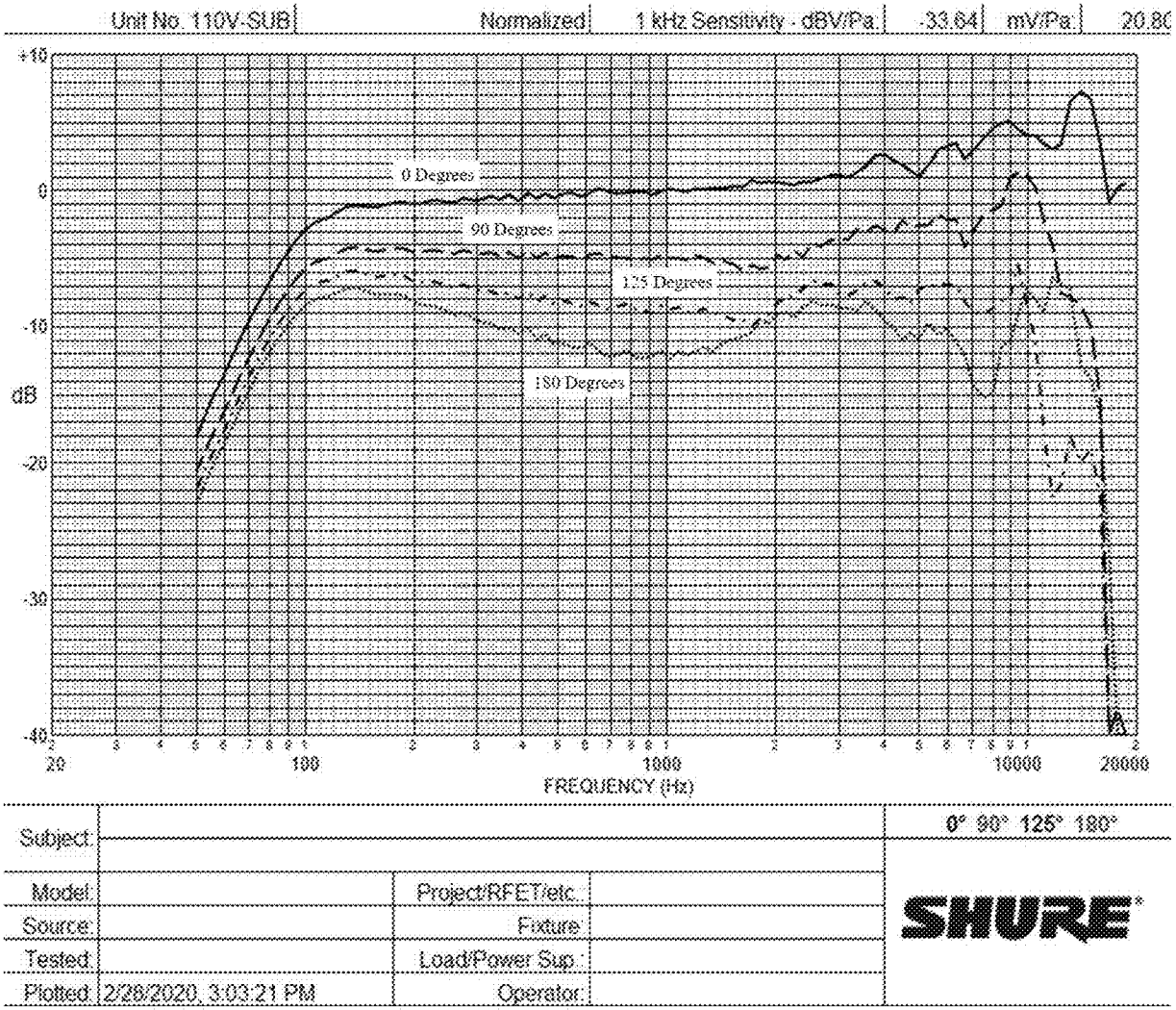
FIG. 6D illustrates a frequency response plot of the example condenser microphone of FIG. 2 with a −110 V external bias applied to the rear diaphragm.

FIG. 6D illustrates the frequency plot of microphone 100 with an external bias of −110 V, giving the microphone a sub-cardioid pattern as illustrated in FIG. 5D. This pattern is closer to an omni-directional pattern, picking up more sound from behind the microphone. As shown, microphone 100 is again most receptive to frequencies at 0° (solid line), but it is also relativity much more receptive at 90° (dashed line), 125° (dot and dash line), and 180° (dotted line) than the patterns shown in FIGS. 6A-6C. This is also consistent with the sub-cardioid pattern illustrated in FIG. 5D.

In another embodiment, a microphone capsule comprising a diaphragm; a backplate with a first biasing mechanism, such as an electret material, that is fixed; and a second biasing mechanism, such as an external voltage, that is variable and interacts with the first biasing mechanism to adjust at least a sensitivity or a polarity of the microphone capsule. The second biasing mechanism can be applied to the diaphragm or the backplate of the microphone capsule and can be varied remotely.

Other embodiments may include more than two microphone capsules and aligning the capsules in various orientations to each other. For example, another embodiment may be a mid/side microphone. In this embodiment, one microphone capsule is pointed to the front of the microphone and is tuned to a cardioid polar pattern. A second microphone capsule is pointed to the side, or 90 degrees from the front of the microphone. This second microphone capsule is tuned to a bi-directional pattern. If the "left" lobe of the bi-directional pattern is negative and the "right" lobe of the bi-directional pattern is positive, adding the output of the second microphone capsule to the output of the first microphone capsule would result in a total microphone output of a cardioid pattern directed to the right of the front of the microphone. Similarly, subtracting the output of the second microphone capsule from the output of the first microphone capsule would result in a total microphone output of a cardioid pattern directed to the left of the front of the microphone. The degree to which the total microphone output is directed left or right of the front of the microphone depends on the amount of output of the second microphone capsule is added to or subtracted from the output of the first microphone output. One can use the combination biasing of an electret and external biasing for the second capsule to provide a continuously variable total microphone output to any angle, right or left, from the front of the microphone.

Finally, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A microphone comprising:

a first microphone capsule with a first polar pattern; and a second microphone capsule comprising:

a diaphragm;

a backplate with a first biasing mechanism that is fixed; and a second biasing mechanism that is variable and interacts with the first biasing mechanism to adjust at least a sensitivity and a second polar pattern of the second microphone capsule;

wherein the microphone produces a single output based on a total polar pattern, wherein the total polar pattern comprises a superposition of the first polar pattern and second polar pattern;

wherein the first microphone capsule is tuned between two polar patterns and the second biasing mechanism allows continuously variable adjustment of the total polar pattern between the two polar patterns of the first microphone capsule; and wherein the first biasing mechanism is fixed so that the second biasing mechanism does not switch polarity.

2. The microphone of claim 1, wherein the first biasing mechanism is an electret material.

3. The microphone of claim 2, wherein the second biasing mechanism is an external voltage.

4. The microphone of claim 1, wherein the second biasing mechanism is applied to the diaphragm.

5. The microphone of claim 1, wherein the second biasing mechanism is applied to the backplate.

6. The microphone of claim 1, wherein the second biasing mechanism is continuously variable.

7. The microphone of claim 1, wherein the second biasing mechanism is able to be varied remotely.

8. The microphone of claim 1 wherein the total polar pattern is variable between omni, cardioid, hyper-cardioid, super-cardioid, sub-cardioid, or bi-directional polar patterns.

9. A method for varying the polar pattern of a microphone comprising:

including at least two microphone capsules in the microphone, wherein each microphone capsule has an individual polar pattern, wherein a first microphone capsule of the at least two microphone capsules is tuned between two polar patterns, and wherein a second microphone capsule of the at least two microphone capsules comprises a backplate and a diaphragm;

applying a fixed bias to the backplate to create an electric potential between the backplate and the diaphragm; and applying a variable bias that interacts with the fixed bias to adjust at least a sensitivity and an individual polar pattern of the second microphone capsule, wherein the microphone produces a single output based on the polar pattern of the microphone that comprises a superposition of the individual polar patterns that occurs within the microphone, wherein the variable bias allows continuously variable adjustment of the polar pattern of the microphone between the two polar patterns of the first microphone capsule, and wherein the fixed bias is fixed so that the variable bias does not switch polarity.

10. The method of claim 9, wherein the fixed bias is created with an electret material.

11. The method of claim 10, wherein the variable bias is applied by an external voltage.

12. The method of claim 10, wherein the variable bias is applied to the diaphragm.

13. The method of claim 10, wherein the variable bias is applied to the backplate.

14. The method of claim 11, wherein the variable bias is continuously variable.

15. The method of claim 11, wherein the variable bias is able to be adjusted remotely.

16. A microphone comprising:

at least a first microphone capsule with a first polar pattern tuned between two polar patterns and a second microphone capsule with a second polar pattern;

wherein the second microphone capsule comprises at least a diaphragm and a backplate;

wherein the second microphone capsule has both a fixed bias and a variable bias;

wherein the variable bias allows adjustment of at least a sensitivity and a polarity of the second polar pattern;

wherein the microphone has a total polar pattern comprising a superposition of the first polar pattern and second polar pattern;

wherein the total polar pattern is continuously variable between the two polar patterns that the first polar pattern is tuned between based on the variable bias of the second microphone capsule;

wherein the microphone has a single output based on the total polar pattern; and wherein the fixed bias is fixed so that the variable bias does not switch polarity.

17. The microphone of claim 16, wherein the fixed bias is created by an electret material on the backplate.

18. The microphone of claim 17, wherein the variable bias is created by an external voltage.

19. The microphone of claim 18, wherein the variable bias is applied to the diaphragm.

20. The microphone of claim 18, wherein the variable bias is applied to the backplate.

21. The microphone of claim 18, wherein the microphone further comprises a wireless device that allows adjustment of the variable bias to be done remotely.

* * * * *